US008758112B2

(12) United States Patent
Lyons et al.

(10) Patent No.: US 8,758,112 B2
(45) Date of Patent: Jun. 24, 2014

(54) GAMING SYSTEM AND A METHOD OF GAMING

(75) Inventors: Martin Stephen Lyons, Lane Cove (AU); Robert Linley Muir, Lane Cove (AU)

(73) Assignee: Aristocrat Technologies Australia Pty Limited (AU)

( * ) Notice: Subject to any disclaimer, the term of this patent is extended or adjusted under 35 U.S.C. 154(b) by 576 days.

(21) Appl. No.: 12/133,997

(22) Filed: Jun. 5, 2008

(65) Prior Publication Data

US 2009/0093294 A1 Apr. 9, 2009

(30) Foreign Application Priority Data

Jun. 8, 2007 (AU) ..... 2007903105

(51) Int. Cl.
*A63F 9/24* (2006.01)

(52) U.S. Cl.
USPC ..... 463/17; 463/20

(58) Field of Classification Search
None
See application file for complete search history.

(56) References Cited

U.S. PATENT DOCUMENTS

| | | | | |
|---|---|---|---|---|
| 5,857,909 | A * | 1/1999 | Rubin | 463/17 |
| 5,980,384 | A | 11/1999 | Barrie | |
| 6,830,514 | B2 * | 12/2004 | Meyer et al. | 463/17 |
| 2002/0169017 | A1 * | 11/2002 | Visoenik | 463/17 |
| 2004/0077398 | A1 * | 4/2004 | Jarvis et al. | 463/17 |
| 2004/0210507 | A1 * | 10/2004 | Asher et al. | 705/37 |
| 2004/0219969 | A1 | 11/2004 | Casey et al. | |
| 2005/0085286 | A1 * | 4/2005 | Muskin | 463/13 |
| 2005/0192079 | A1 * | 9/2005 | Lowery | 463/17 |
| 2005/0215307 | A1 * | 9/2005 | Jarvis et al. | 463/17 |
| 2005/0227753 | A1 * | 10/2005 | Luciano, Jr. | 463/18 |
| 2006/0287035 | A1 | 12/2006 | Walker et al. | |
| 2007/0167208 | A1 * | 7/2007 | Acres | 463/16 |
| 2009/0203422 | A1 * | 8/2009 | Ellis | 463/20 |
| 2009/0280886 | A1 * | 11/2009 | Randhawa | 463/17 |

FOREIGN PATENT DOCUMENTS

| | | |
|---|---|---|
| GB | 2424192 | 9/2006 |
| WO | WO0184515 | 11/2001 |

* cited by examiner

*Primary Examiner* — Dmitry Suhol
*Assistant Examiner* — Carl V Larsen
(74) *Attorney, Agent, or Firm* — McAndrews, Held & Malloy, Ltd.

(57) ABSTRACT

A gaming system comprises a primary game monitor arranged to monitor outcomes of a sequence of primary games. An outcome generator provided by the gaming system determines an outcome of a secondary game in dependence on the outcomes of the sequence of primary games.

22 Claims, 8 Drawing Sheets

GAMING SYSTEM AND A METHOD OF GAMING

RELATED APPLICATIONS

This application claims priority to Australian Provisional Patent Application No. 2007903105, having an international filing date of 8 Jun. 2007, entitled "A Gaming System And A Method Of Gaming," which is hereby incorporated by reference herein in its entirety.

FEDERALLY SPONSORED RESEARCH OR DEVELOPMENT

Not Applicable

MICROFICHE/COPYRIGHT REFERENCE

Not Applicable

BACKGROUND OF THE INVENTION

The present invention relates to a gaming system and a method of gaming, and particularly, but not exclusively, to a gaming system and method of gaming which is applicable to wheel games.

Gaming is implemented by many types of gaming systems providing many different types of games.

These include "wheel" games, such as traditional casino type roulette. Wheel games typically involve a wheel divided into equal segments, usually being associated with indicia. To play a game, the wheel is spun and the outcome is determined by a pointer which selects indicia when the wheel has stopped. In the case of roulette, for example, the pointer is a ball which rolls into one of the segments as the roulette wheel comes to a halt.

Wheel games may be implemented by mechanical systems (such as the conventional roulette wheel) and they may also be simulated electronically, for example by an Electronic Gaming Machine (EGM).

To play a wheel game, players may place bets on a player predicted outcome from a spin of the wheel. If the player predicted outcome matches the game outcome, the player may win the bet. For example, the player predicted outcome may be a particular indicium which the player may have predicted the wheel will stop at. If the wheel stops at that indicium then the player wins the bet.

Conventionally, players may place player predicted outcomes with a banker or croupier. It is also known to provide electronic player input terminals for players to input player predicted outcomes for wheel games, and also input bets. It is known, for example, to play roulette as an electronic table game which includes a roulette wheel which may be automatically spun and a plurality of player input terminals for inputting player predicted outcomes and bets.

It is also known to provide a gaming system which comprises a game controller arranged to randomly display several symbols from a predetermined set of symbols and to determine a game outcome such as a game win based on the displayed symbols. Such gaming systems may commonly be implemented as a stepper machine provided with reels with each reel carrying several symbols of the set, or a video machine wherein selected symbols are displayed on virtual reels on a graphical display device. Win outcomes can occur based on symbols appearing in one or more horizontal lines, diagonal lines, or in any other predetermined way.

In wheel games, each game is usually played by a single spin of the wheel. In wheel games such as roulette or chocolate wheels, which are played with a single wheel, the odds against winning are generally quite low (because with a single wheel there are only generally a limited number of segments that can be provided—only 38 in roulette, for example). Where the odds against winning are not that great, there is a reluctance on the part of the game administrator (casino, for example) to provide incentives to play, such as large jackpots. Also there is little variety to retain player interest.

BRIEF SUMMARY OF THE INVENTION

In accordance with a first aspect, the present invention provides a gaming system, comprising a primary game monitor arranged to monitor outcomes of a sequence of primary games, and an outcome generator arranged to determine an outcome of a secondary game in dependence on the outcomes of the sequence of primary games.

In an embodiment, the outcomes of each primary game are one or more indicia, and the outcome of the secondary game is a combination of the one or more indicia outcomes of the sequence of primary games.

In an embodiment, the primary game is a wheel game, such as roulette or a chocolate wheel or a reel of a slot machine, or any other wheel game. The wheel game may be played utilizing conventional mechanical wheels, or may be emulated as an electronic table game or via an EGM.

In an embodiment, the primary game is a card game, such as Blackjack or Poker or any other card game. The card game may be played with conventional cards, or may be an emulated card game played as an electronic table game or via an EGM.

In an embodiment, the gaming system further comprises a player input enabling a player to make a player predicted outcome for the secondary game. The player input may also enable the player to place a bet. In an embodiment, the system further comprises a sequence selector enabling selection of the sequence of primary games on which the outcome of the secondary game will be dependent. This selection may be made by the player.

An advantage of at least an embodiment of the invention, is that the interest and excitement in a game may be increased because the player can play a secondary game which depends on the outcomes of a primary game. The odds against winning the secondary game may be greater than the odds against winning the primary game, such that large, attractive prizes may be awarded. For example, in roulette, the player may place a "side bet" on the secondary game. For example, the player may bet that over a sequence of a number of successive spins of the roulette wheel, the ball will land in a red colour zone each time. The odds against this occurring (which will depend on the number of games in the sequence) may be significantly greater than the 1 in 38 odds of selecting the correct number in the primary game.

In an embodiment, a progressive jackpot may be associated with the secondary game. The progressive jackpot may be a linked progressive jackpot.

In accordance with a second aspect, the present invention provides a method of gaming, comprising the steps of monitoring outcomes of a sequence of primary games, and determining an outcome of a secondary game in dependence on the outcomes of the sequence of primary games.

In an embodiment, the outcome of the primary game is one or more indicia and the step of determining an outcome of the secondary game is based on combining the one or more indicia outcomes of the primary games in the sequence.

In an embodiment, the game is a wheel game.

In an embodiment, the game is a card game.

In an embodiment, the player may make a player predicted outcome of the secondary game. The player may place a bet on the player predicted outcome. If the player predicted outcome matches the game outcome, the player may win the bet.

In accordance with a third aspect, the present invention provides a computer program comprising instructions for controlling a computer to implement a gaming system in accordance with the first aspect of the invention.

In accordance with a fourth aspect, the present invention provides a computer readable medium providing a computer program in accordance with the third aspect of the invention.

In accordance with a fifth aspect, the present invention provides a data signal comprising a computer programme in accordance with the third aspect of the invention.

BRIEF DESCRIPTION OF SEVERAL VIEWS OF THE DRAWINGS

Features and advantages of the present invention will become apparent from the following description of embodiments thereof, by way of example only, with reference to the accompanying drawings, in which.

DETAILED DESCRIPTION OF THE INVENTION

Figure 1:
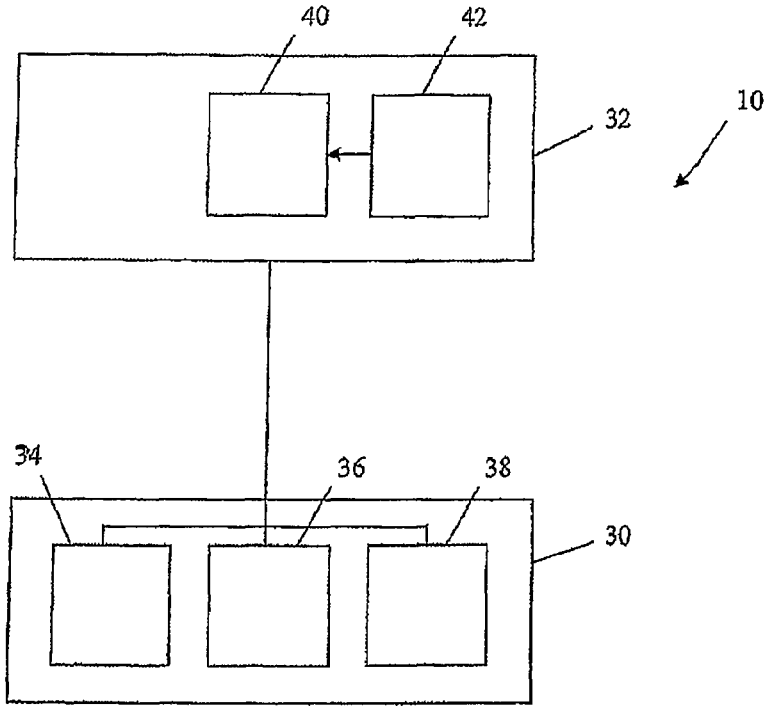
FIG. 1 is a schematic block diagram of core components of a gaming system in accordance with an embodiment of the present invention.

Embodiments of the present invention relate generally to playing of a secondary game, the results of which are based on outcomes of sequential plays of a primary game. A player may place a "side bet" on the outcome of the secondary game. The primary game may be any game, but in embodiments described herein is a wheel game, such as roulette or a chocolate wheel or any other wheel game, or a card game, such as poker, black jack, or any other card game. The primary game may be operated manually (e.g. conventional roulette, conventional card games, etc) or may be emulated electronically or played as an electronic table game. Outcomes of the primary game are monitored in order to implement the secondary game.

Referring to the drawings, there is shown a schematic block diagram of a gaming system 10 arranged to implement a probabilistic game of the type wherein indicia, in this example in the form of several symbols from a set of symbols, are randomly displayed, and a game outcome is determined on the basis of the displayed symbols. The game may be a wheel game which may be emulated electronically, for example, such as roulette. The symbols in this case correspond to the symbols in a conventional roulette game. Alternatively, the game may be any other type of wheel game, such as a chocolate wheel or a money wheel, emulated electronically. In a further alternative, the game may be a card game and the symbols may represent cards.

Referring to FIG. 1, a schematic diagram of core components of a gaming system is shown. The core components comprise a player interface 30 and a game controller 32. The player interface 30 is arranged to enable interaction between a player and the gaming system and for this purpose includes input/output components required for the player to enter instructions and play the game.

Components of the player interface 30 may vary but will typically include a credit mechanism 34 to enable a player to input credits and receive payouts, one or more displays 35 which may comprise a touch screen, and a game play mechanism 38 arranged to enable a player to input game playing instructions.

The game controller 32 is in data communication with the player interface 30 and typically includes a processor 40 arranged to process game play instructions and output game player outcomes to the display 36. Typically, the game play instructions are stored as program code in a memory 42 that can also be hardwired. It will be understood that in this specification the term "processor" is used to refer generically to any device that can process game play instructions and may include a microprocessor, microcontroller, programmable logic device or other computational device such as a personal computer or a server.

The gaming system 10 can take a number of different forms.

In a first form, a stand alone gaming machine is provided wherein all or most components required for implementing the game are present in a player operable gaming machine.

In a second form, a distributed architecture is provided wherein some of the components required for implementing the game are present in a player operable gaming machine and some of the components required for implementing the game are located remotely relative to the gaming machine. For example, a "thick client" architecture may be used wherein part of the game is executed on a player operable gaming machine and part of the game is executed remotely, such as by a gaming server; or a "thin client" architecture may be used wherein most of the game is executed remotely such as by a gaming server and a player operable gaming machine is used only to display audible and/or visible gaming information to the player and receive gaming inputs from the player.

However, it will be understood that other arrangements are envisaged. For example, an architecture may be provided wherein a gaming machine is networked to a gaming server and the respective functions of the gaming machine and the gaming server are selectively modifiable. For example, the gaming system may operate in stand alone gaming machine mode, "thick client" mode or "thin client" mode depending on the game being played, operating conditions, and so on. Other variations will be apparent to persons skilled in the art.

Figure 2:
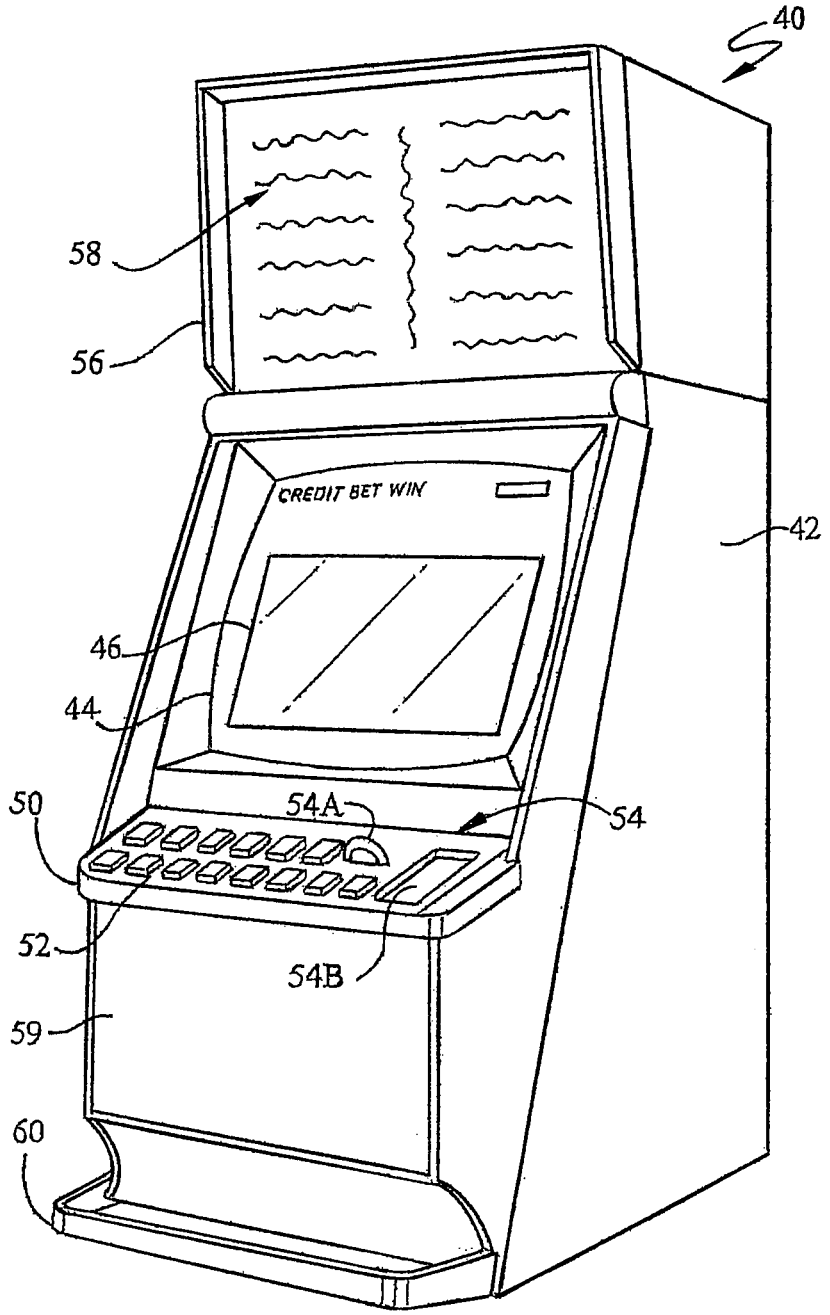
FIG. 2 is a diagrammatic representation of a gaming system in accordance with an embodiment of the present invention with the gaming system implemented in the form of a standalone gaming machine.

A gaming system in the form of a stand alone gaming machine 40 is illustrated in FIG. 2. The gaming machine 40 includes a console 42 having a display 44 on which is displayed representations of a game 46 that can be played by a player. A mid-trim 50 of the gaming machine 40 houses a bank of buttons for enabling a player to interact with the gaming machine, in particular during gameplay. The mid-trim 50 also houses a credit input mechanism 54 which in this example includes a coin input chute 54A and a bill collector 54B. Other credit input mechanisms may also be employed, for example, a card reader for reading a smart card, debit card or credit card. A reading device may also be provided for the purpose of reading a player tracking device, for example as part of a loyalty program. The player tracking device may be in the form of a card, flash drive or any other portable storage medium capable of being read by the reading device.

A top box 56 may carry artwork 58, including for example pay tables and details of bonus awards and other information or images relating to the game. Further artwork and/or information may be provided on a front panel 59 of the console 42. A coin tray 60 is mounted beneath the front panel 59 for dispensing cash payouts from the gaming machine 30.

The display 44 is in the form of a video display unit, particularly a cathode ray tube screen device. Alternatively, the display 44 may be a liquid crystal display, plasma screen, or any other suitable video display unit. The top box 56 may also include a display, for example a video display unit, which may be of the same type as the display 44, or of a different type.

The display 44 in this example is arranged to display a representation of a wheel game, such as roulette. In an alternative embodiment, it may display other types of wheel games, and, in a further alternative embodiment, it may display representations of cards for playing a card game.

Instead of a video display unit displaying representations of symbols for a wheel game or cards, a physical reel display may utilized. Such gaming machines which include actual rotatable reels are commonly termed stepper machines. The game controller of such a gaming machine has a stop determining function that determines the stop position for the wheel. A card game, such as poker, may also be implemented by symbols appearing on a plurality of reels, which may be video emulated reels or stepper reels.

Figure 3:
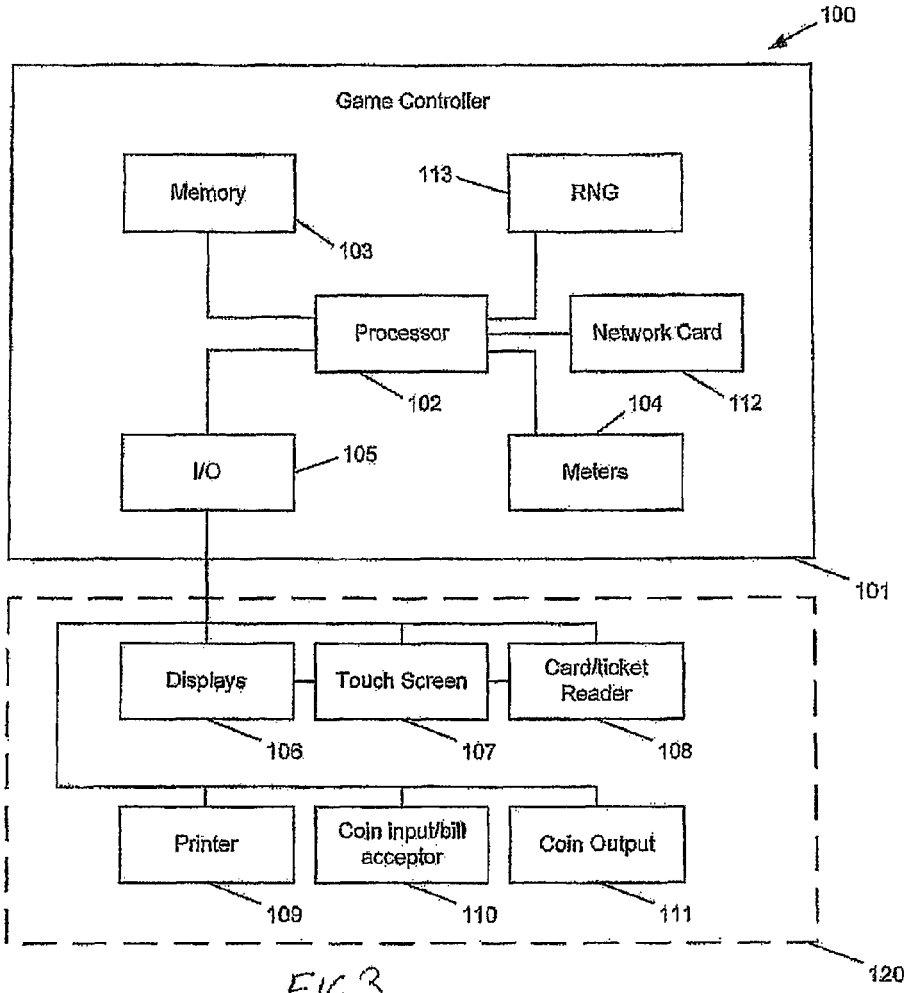
FIG. 3 is a schematic block diagram of operative components of the gaming machine shown in FIG. 2.

FIG. 3 shows a block diagram of operative components of a typical gaming machine 100 which may be the same as or different to the gaming machine shown in FIG. 2.

The gaming machine 100 includes a game controller 101 having a processor 102. Instructions and data to control operation of the processor 102 are stored in a memory 103 which is in data communication with the processor 102.

Typically, the gaming machine 100 will include both volatile and non-volatile memory and more than one of each type of memory, with such memories being collectively represented by the memory 103.

Figure 4:
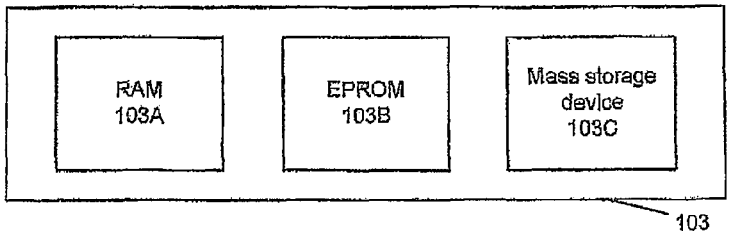
FIG. 4 is a schematic block diagram of components of a memory of the gaming machine shown in FIG. 2.

FIG. 4 shows a block diagram of the main components of an exemplary memory 103. The memory 103 includes RAM 103A, EPROM 103B and a mass storage 103C. The RAM 103A typically temporarily holds program files for execution by the processor 102 and related data. The EPROM 103B may be a boot ROM device and/or may contain some system or game related code. The mass storage device 103C is typically used to store game programs, the integrity of which may be verified and/or authenticated by the processor 102 using protected code from the EPROM 103B or elsewhere.

The gaming machine has hardware meters 104 for purposes including ensuring regulatory compliance and monitoring player credit, an input/output (I/O) interface 105 for communicating with a player interface 120 of the gaming machine 100, the player interface 120 having several peripheral devices. The input/output interface 105 and/or the peripheral devices may be intelligent devices with their own memory for storing associated instructions and data for use with the input/output interface or the peripheral devices. A Random Number Generator is used to provide random numbers for use by the processor 102, and is represented by block 113 in FIG. 3. The random number generator may provide random numbers for facilitating selection of one or more symbols in a wheel game or card game.

In the example shown in FIG. 3, the peripheral devices that communicate with the game controller 101 comprise one or more displays 106, a touch screen and/or bank of buttons 107, a card and/or ticket reader 108, a printer 109, a bill acceptor and/or coin input mechanism 110 and a coin output mechanism 111. Additional hardware may be included as part of the gaming machine 100, or hardware may be omitted as required for the specific implementation.

In addition, the gaming machine 100 may include a communications interface, for example a network card 112. The network card may, for example, send status information, accounting information or other information to a central controller, server or database and receive data or commands from the central controller, server or database.

It is also possible for the operative components of the gaming machine 100 to be distributed, for example input/output devices 106, 107, 108, 109, 110, 111 may be provided remotely from the game controller 101.

Figure 5:
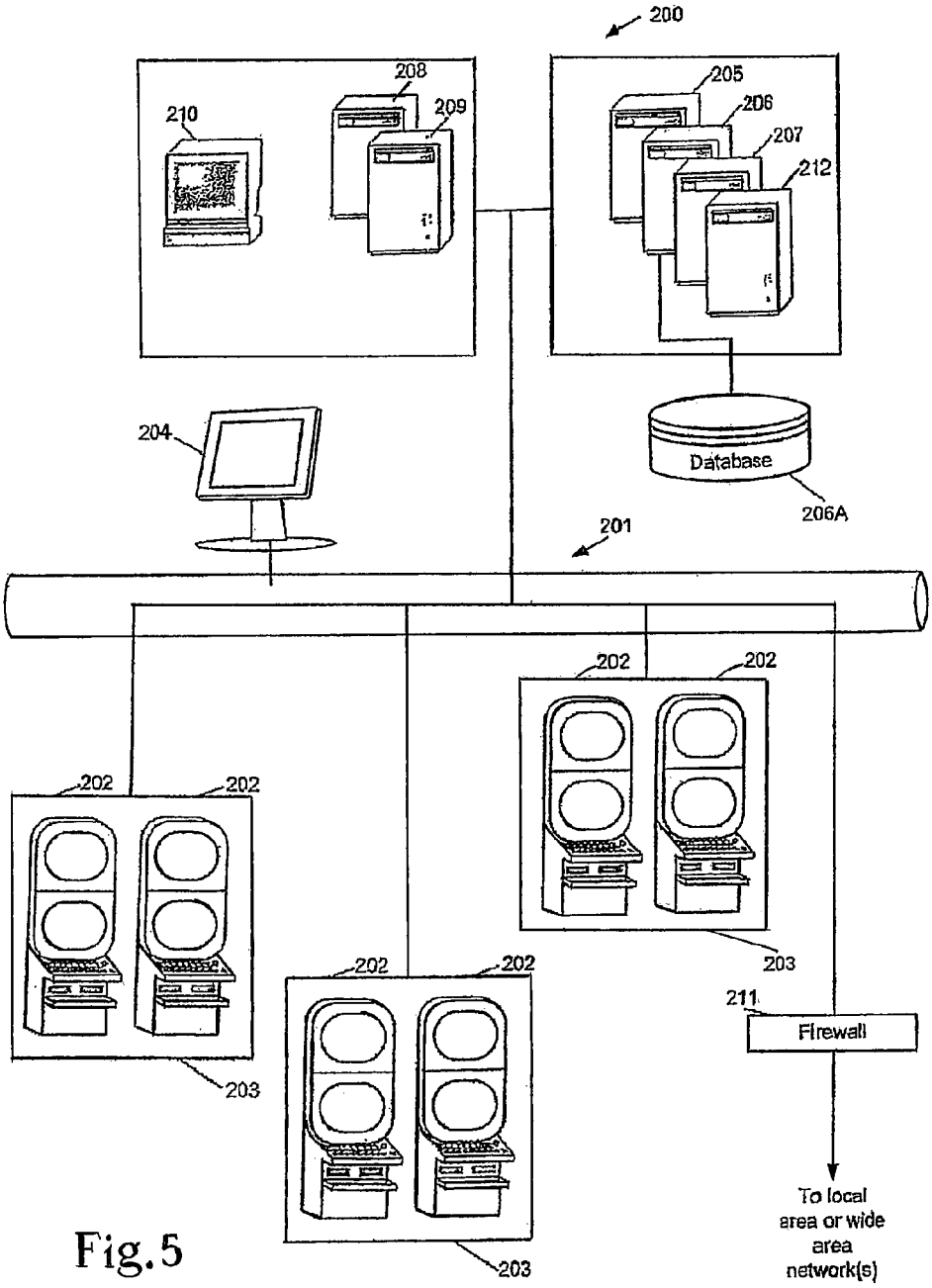
FIG. 5 is a schematic diagram of a gaming system in accordance with an alternative embodiment of the present invention with the gaming system implemented over a network.

FIG. 5 shows a gaming system 200 in accordance with an alternative embodiment. The gaming system 200 includes a network 201, which for example may be an Ethernet network, a LAN or a WAN. In this example, three banks 203 of two gaming machines 202 are connected to the network 201. The gaming machines 202 provide a player operable interface and may be the same as the gaming machines 10, 100 shown in FIGS. 3 and 4, or may have simplified functionality depending on the requirements for implementing game play. While banks 203 of two gaming machines are illustrated in FIG. 5, banks of one, three or more gaming machines are also envisaged.

One or more displays 204 may also be connected to the network 201. The displays 204 may, for example, be associated with one or more banks 203 of gaming machines. The displays 204 may be used to display representations associated with game play on the gaming machines 202, and/or used to display other representations, for example promotional or informational material.

In a thick client embodiment, a game server 205 implements part of the game played by a player using a gaming machine 202 and the gaming machine 202 implements part of the game. With this embodiment, as both the game server 205 and the gaming machine 202 implement part of the game, they collectively provide a game controller. A database management server 206 may manage storage of game programs and associated data for downloading or access by the gaming devices 202 in a database 206A. Typically, if the gaming system enables players to participate in a Jackpot game, a Jackpot server 207 will be provided to monitor and carry out the Jackpot Game.

In a thin client embodiment, the game server 205 implements most or all of the game played by a player using a gaming machine 202 and the gaming machine 202 essentially provides only the player interface. With this embodiment, the game server 205 provides the game controller. The gaming machine will receive player instructions, and pass the instructions to the game server which will process them and return game play outcomes to the gaming machine for display. In a thin client embodiment, the gaming machines could be computer terminals, e.g. PCs running software that provides a player interface operable using standard computer input and output components.

Servers are also typically provided to assist in the administration of the gaming system 200, including for example a gaming floor management server 208 and a licensing server 209 to monitor the use of licenses relating to particular games. An administrator terminal 210 is provided to allow an administrator to monitor the network 201 and the devices connected to the network.

The gaming system 200 may communicate with other gaming systems, other local networks such as corporate network, and/or a wide area network such as the Internet, for example through a firewall 211.

Persons skilled in the art will appreciate that in accordance with known techniques, functionality at the server side of the network may be distributed over a plurality of different computers. For example, elements may be run as a single "engine" on one server or a separate server may be provided. For example, the game server 205 could run a random number generator engine. Alternatively, a separate random number generator server could be provided.

An embodiment of the present invention will now be described where a primary game is a wheel game, in this example being roulette. Utilizing the architecture as described with reference to FIGS. 1 through 5, roulette may be implemented on a stand alone machine, such as that described with reference to FIG. 2 (known as an EGM). Alternatively, two or more linked EGMs may play a common game of roulette for which multiple players can place bets via the linked EGMs. Networked architecture may also be used to play the roulette, either thick client or thin client architecture being applied. Yet a further alternative is to play roulette as a "table game" where player input terminals are associated with a single central game of roulette. The difference between this and linked EGMs or gaming terminals playing a single game of roulette, is that the player input terminals are generally arranged around a table where the roulette game can be observed by the players sitting at the terminals.

Figure 6:
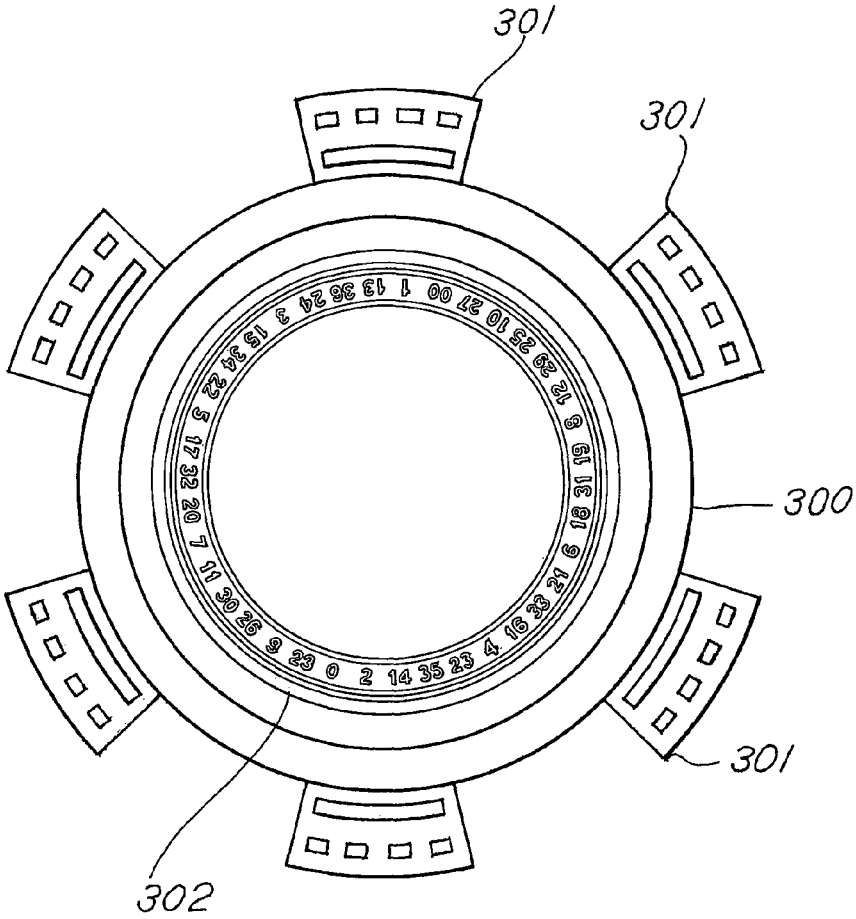
FIG. 6 is a schematic diagram of a gaming system in accordance with a further embodiment of the present invention, implemented as a "table game"

A diagram of a roulette table game is shown in FIG. 6. In this embodiment, a central table 300 is provided with player input terminals 301 placed about the table in positions where players are able to sit next to them and manipulate the terminals 301. A roulette wheel 302 is provided at the table. A stepper motor may be provided to spin the roulette wheel 302. Alternatively, the roulette wheel may be emulated by a video display. As with previously described architectures, the stand alone table game will include a game controller 32 (FIG. 1) as well as the player interface 20 (in this embodiment implemented by the player terminals 301). Similar components such as a credit mechanism 34 are also provided to enable players to place bets via the player input terminals 301. Various meters may also be included as described above, for ensuring regulatory compliance and monitoring player credit.

Roulette, when played as an electronic table game, by linked or stand alone EGMs, or as conventional roulette (with a mechanical wheel and croupier) is played by spinning the roulette wheel and seeing which segment of the wheel a roulette ball stops in when the wheel has stopped spinning. Players may place bets on a number of game outcomes, including betting on one or more numbers, or betting on whether the ball stops at a red colour segment or a black colour segment. The odds against winning will vary depending upon the type of bet made. For example, with a bet on a segment colour, the odds are generally evens. With the type of wheel illustrated on FIG. 6 (an American-type roulette wheel) the maximum odds for picking a single number are 38 to 1. In the alternative (French) roulette wheel, the wheel is divided into 37 equal segments and the odds of picking a single number are 37 to 1.

In accordance with an embodiment of the present invention, a secondary game is implemented. The outcome of the secondary game depends on the outcomes of a sequence of the primary games. For example, a player may decide to place a side bet that, in a sequence of the next four spins of the roulette wheel 302, the ball will fall on a red colour indicia on each spin. If in the next four occurrences, the ball does fall in a red segment, then the player wins the side bet for the secondary game.

In this embodiment, the player places the side bet by a player input (301 in FIG. 5, 54 in FIG. 2). A number of predetermined outcomes and sequences may be provided by the gaming system for the player to select from for the secondary game, or the player may, in other embodiments, choose their own sequence and predicted outcomes for the secondary game.

The game controller 32, 101 in this embodiment implements a primary game monitor to monitor the outcomes of the primary game and an outcome generator to compare the outcomes of the primary game with the player predicted outcomes for the secondary game, to make a determination as to whether a player has won the secondary game. It is possible that the primary game outcomes and secondary game outcomes could be monitored and determined manually in simple cases, but in the gaming system of this embodiment, the game controller implements these processes. For complex secondary games, it will be appreciated that it would be very difficult for the secondary game to be monitored and outcome determined manually.

The game controller 32, 101 in this embodiment may also implement a sequence selector. The sequence selector enables selection of the sequence of primary games the outcomes of which are to be used to determine the outcome of the secondary game. Via the player input, the player may, in one embodiment, select the sequence of primary games that he wishes to use.

In a roulette embodiment many sequences of primary game outcomes are available for utilizing in the secondary game. For example, a player may bet on a particular sequence of numbers as outcomes of the next 2, 3, 4, 5 or more wheel spins, where each of the individual outcomes within the sequence may include any of the normal outcomes of the traditional game. For example, a bet may be made on a sequence of three games, where for the individual games in the series the outcomes must be red, black, and red. Another example may be red, first spin, and then stop on 10, 11 or 12 (numbers) in the next spin.

Many variations are available for a secondary game in roulette. Virtually any combinations of outcomes of the primary game can be thought of for use in the secondary game and may be implemented with the game controller programmed accordingly.

In some embodiments, the primary game outcome that is used for the secondary game, may not be the prize winning outcome of the primary game. For example, in one embodiment, a "scatter" function may be implemented. In a scatter, a win will occur if the roulette wheel stops either at the winning symbol (of the primary game) or at the symbol directly to the left or right of the primary game. A "substitution" feature may also be implemented. In a substitution, the stop position will be treated as if it were another stop position which would have caused the sequence to win. For example, in an embodiment, the green stop position may substitute for red. A bet on "red, red, red" would win in the secondary game if the sequence of outcomes were "red, red, green".

The sequence for the secondary game is not limited to being a sequence of successive spins of the wheel. Non-successive spins of the wheel may form part of a sequence for play of the secondary game. For example, the sequence may be based on alternate spins of the wheel. Or it may be the first spins, fifth spin and last spin in a succession of ten spins of the wheel. The sequence may be any sequence.

As discussed above, side bets may be offered as one or more selections from a series of available side bets, predetermined by the gaming systems. For example, in a roulette table game, such as that illustrated in FIG. 6, the gaming system may offer a selection from an availability of ten side bets, each having a particular sequence and required outcome for a player to win. Limiting the number of available side bets for the secondary games will keep the gaming system relatively simple.

In a more complex embodiment, the gaming system may provide a dynamic pay table in which the player may choose their own sequence and outcomes and the gaming system will calculate and indicate a prize that will be awarded if that outcome occurs.

In another embodiment, sequences may be given shorthand names, such as "first", "last" and "any" respectively. So that the player may bet on a particular outcome for the first N, last N or any N of a series of roulette games. For example in a series of five roulette games, the side bet may be that any three of the five outcomes is red.

It will be appreciated that many variations are available for secondary games, in fact as many sequences of outcomes for the primary game that can be thought of.

Figure 7:
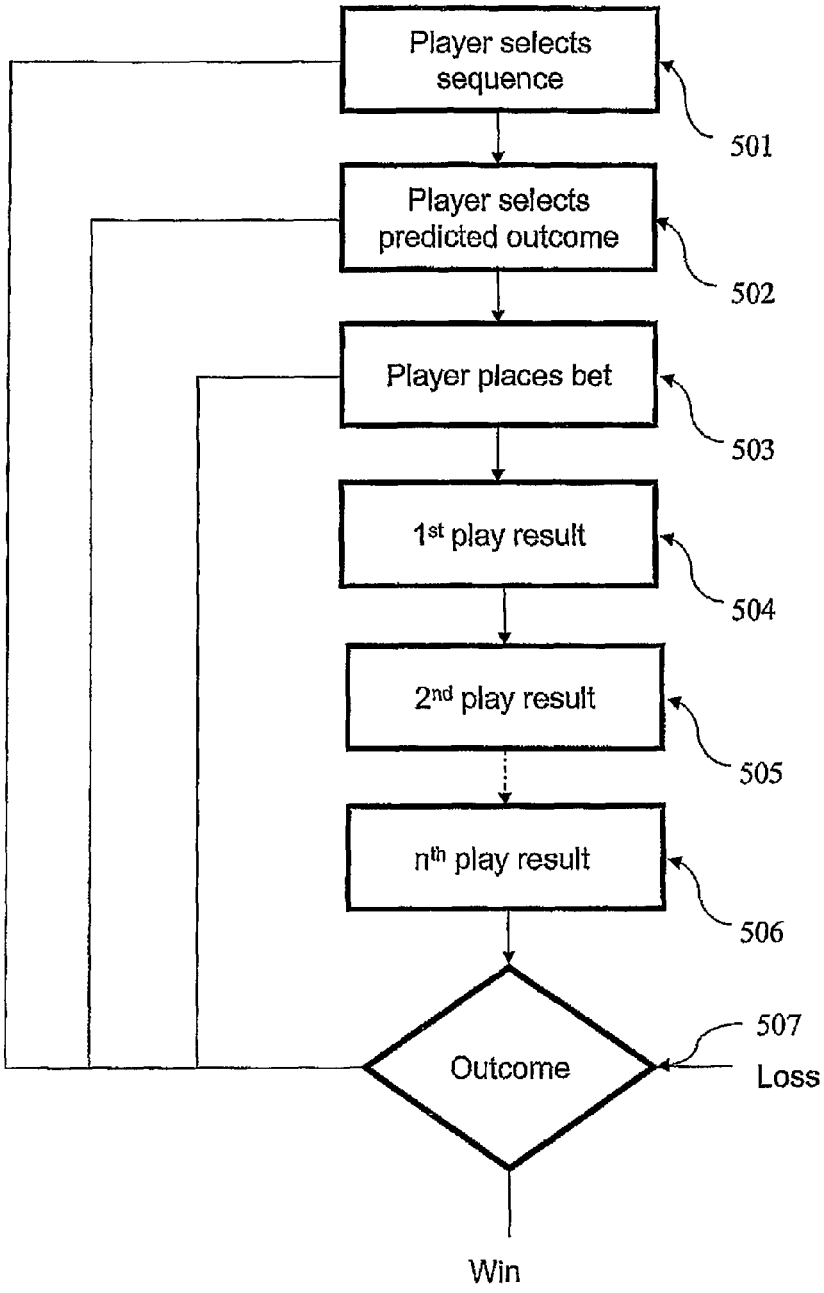
FIG. 7 is a flow diagram illustrating operation of a gaming system in accordance with an embodiment of the present invention.
Figure 8A:
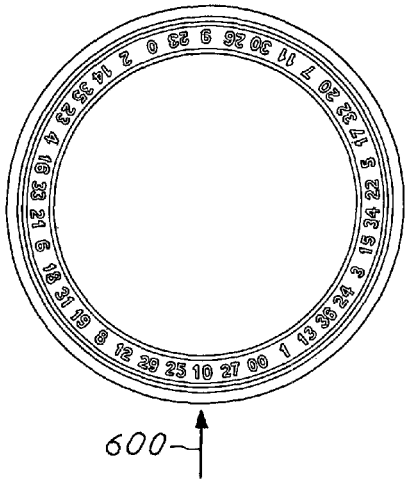
FIGS. 8*a* to 8*d* are diagrams of an example implementation of a wheel game illustrating operation in accordance with an embodiment of the present invention.
Figure 8B:
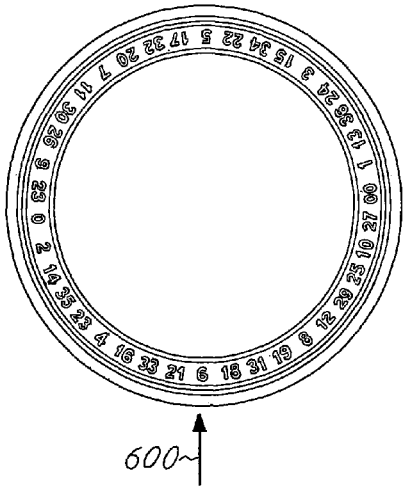
Figure 8C:
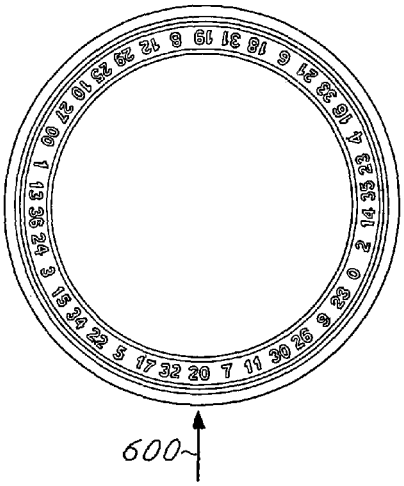
Figure 8D:
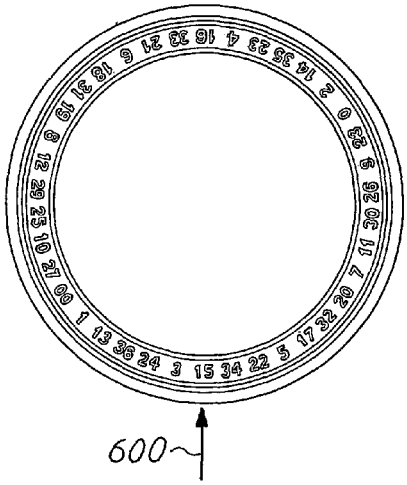

A flow diagram illustrating the process of placing a side bet on a secondary game in accordance with an embodiment of the present invention will now be described with reference to FIG. 7.

In this embodiment, a player has the option of being able to select the sequence of primary game plays which will form the basis for the secondary game. At step 501 the player inputs his selected sequence. For example, where the game is roulette, the player may select the next four successive plays of the primary roulette as the sequence. At step 502 the player inputs the predicted outcome for each of the primary games in the selected sequence. In the roulette example, the player may select that the predicted outcome for each of the four next spins of the roulette wheel is that the roulette ball should stop at a black colour segment. At step 503 the player places a bet of a money amount on his secondary bet. Playing of the primary game then continues and the next "n" results are monitored for the secondary game (step 504, 505, 506). The outcomes of the n plays are monitored (step 507) and compared with the player selections (sequence, predicted outcome and bet) and determination is made whether the player has lost or won the secondary game (step 507).

FIG. 8 illustrates the outcomes of this roulette game example. In this drawing the position of the roulette ball is indicated by pointer 600. FIGS. 8*a*, 8*b*, 8*c* and 8*d* represent, respectively, the next four sequential spins of the roulette wheel against which the player has placed the side bet. In each case, the roulette wheel has stopped at a black segment, being black segment 10 in FIG. 8*a*, black segment 6 in FIG. 8*b*, black segment 20 in FIG. 8*c* and black segment 15 in FIG. 8*d*. Our player has therefore won their side bet. As discussed above, many different side bets may be available.

In an embodiment, the secondary game may not be played with the same indicia from which a primary game result is determined. Instead, secondary symbols may be associated with the primary game indicia. For example, in a wheel game, a set of secondary symbols may be located in a ring inside the traditional indicia. The secondary game may be played on the basis of the secondary symbols. For example, ten of the symbols in a roulette wheel may be associated with a "heart" secondary symbol. A player may place a side bet for the next five spins of the wheel that the outcome will be a roulette segment which is associated with a heart secondary symbol. In such an embodiment, the outcome of the primary game is associated with a secondary symbol which is the outcome of the primary game for playing the secondary game. Secondary symbols may be applied in embodiments for all roulette games and also for card games and any other games, in accordance with embodiments of the present invention.

The secondary indicia may be either static printed artwork or electronically programmable displays (where an electronic display is utilised to play the primary game). A programmable display permits flexibility in the game such that different sets of indicia may be displayed, with different mathematical properties for the secondary game.

In an embodiment of the invention, a "feature game" may be triggered. For example, on the basis of a side bet in roulette that the next three spins land on a specified colour, if the side bet is successful a free feature game may be triggered. A feature game may be any feature game. For example, it may be a series of free games of conventional roulette. It may be one or a series of free secondary games. It may be a game unrelated to the wheel game, such as a slot machine game e.g. spinning of reels or virtual reels to give a slot outcome for the feature game.

In a further embodiment, the secondary game could be linked to progressive jackpot systems, increasing the amount that may be won significantly. As discussed above, the odds against winning any particular wheel game are not large. With the implementation of a secondary game, the wheel game can be usefully connected to any progressive jackpot system. This is because the mathematics of side bets offer much more flexibility. For example, with a French-type roulette wheel, the probability of green occurring five consecutive times is one in $37^5$. This is quite suitable for progressive games and large jackpots.

Where a number of players are sharing a single wheel game, and players make the same side bet, then they would share in the jackpot. There may be several ways of implementing jackpot payments in these circumstances. For example:

1. A display prize value is split among the players who won it.
2. The display prize value is awarded to all players.
3. A secondary game is played to decide a single player who will win the entire prize.
4. One or more secondary games is played to determine a subset of the players who will split the prize, and determine in what proportion they will split the prize.

A jackpot game may be provided as a single progressive jackpot on a stand alone machine, or a linked progressive jackpot for a plurality of linked machines.

Figure 9:
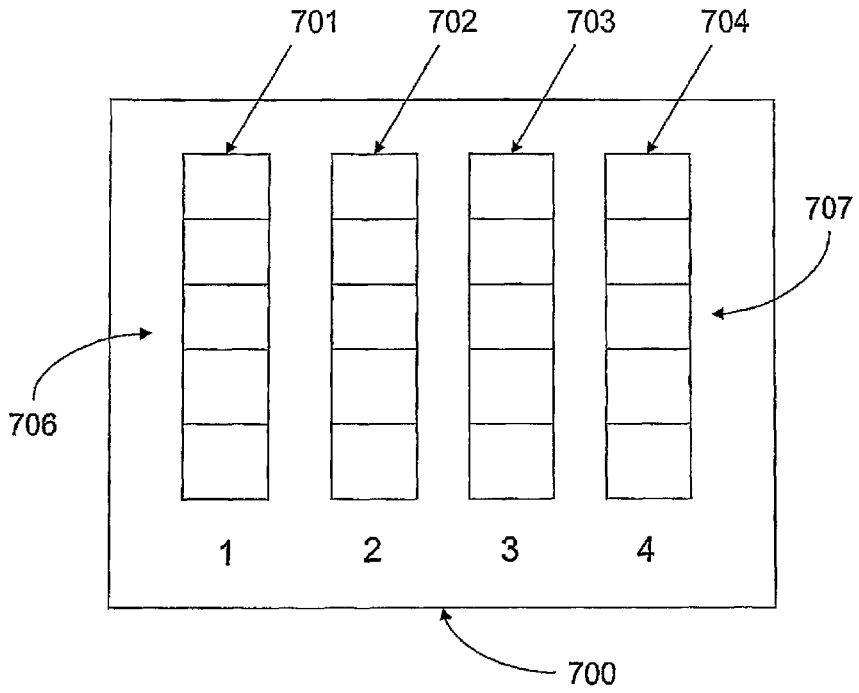
FIG. 9 is a schematic diagram of a display which may be utilised in accordance with an embodiment of the present invention.

In an embodiment, progression of a secondary game may be presented to the players by a display in the form of a slot game. Referring to FIG. 9, a display panel 700 shows four emulated slot reels 701, 702, 703, 704. Each one of these reels represents a respective one in the sequence of primary games forming the basis of a secondary game. For example, in roulette, the results of a sequence of successive spins of a roulette wheel may be represented as reel 701, 702, 703, 704. Players involved in the side bet may, therefore, monitor the outcome of the side bet via the display 700. Note that there may be more or less wheels than illustrated in FIG. 9 depending upon the side bets that are available for a particular embodiment of the invention. Pointer 705, 706 may indicate the outcomes of the primary game which form the basis of the secondary game.

The display 700 may be dynamic, showing representations of more or less reels, depending upon the side bets available and selected.

Slot representation 700 may be associated with a single gaming machine or may be a large display common to many players, for example a large LCD or plasma display.

In embodiments, players may place bets at various stages of a secondary game. For example, where a slot-type display is provided so that players can monitor the secondary game, the player may make a bet on the position of one wheel of the slot display. For example the positions of the first three reels may be known, and the player may then make a bet that the fourth reel will complete a sequence e.g. all number 10s, together with the other three reels.

A feature of the wheel game embodiments described above is that the secondary game is played across time. That is, it requires a sequence of primary games to be played (across time) in order to obtain the results of the secondary game. This concept is not limited to wheel games and can be applied to many other games.

In an embodiment, the primary game may be a card game. A secondary game may be played across a number of hands in time. For example, one secondary bet may be the first card dealt in a sequence of five hands will be a heart card each time. Five successive hands in the sequence are therefore monitored for the secondary game. Other combinations and sequences may be made.

In another alternative, secondary games across time may be played on slot machines. For example one reel of a slot machine may enable a secondary game. Side bets may be made on outcomes of a plurality of sequences of the one reel of the slot machine. A player may also be given the choice of selection of which reel the secondary game is played with. This concept may be applied to any wheel game where there are multiple wheels e.g. multiple chocolate wheels.

Persons skilled in the art will also appreciate that methods of embodiments of the present invention may be embodied in programme code. The programme code could be supplied in a number of ways, for example on a computer readable medium, such as a disk or a memory (for example, that could replace part of memory 103) or as a data signal (for example, by downloading it from a server).

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

The invention claimed is:

1. A gaming system for making sequential plays of a primary game in order to provide a secondary game, the gaming system comprising:

a sequence selector configured to receive a player selection of (1) particular ones of non-consecutive successive repetitions of the primary game and (2) outcomes associated with the particular ones of said non-consecutive successive repetitions of the primary game;

a primary game monitor configured to monitor the selected outcomes of the particular ones of said non-consecutive successive repetitions of the primary game;

an outcome generator configured to determine an outcome of the secondary game in dependence on the selected outcomes associated with the particular ones of said non-consecutive successive repetitions of the primary game; and a game controller configured to dynamically calculate a paytable in dependence on the outcomes associated with the particular ones of said non-consecutive successive repetitions of the primary game, and to award a prize determined using the dynamically calculated paytable.

2. A gaming system in accordance with claim 1, wherein the outcomes associated with the particular ones of said non-consecutive successive repetitions of the primary game are a plurality of indicia, and the outcome of the secondary game is a combination of the plurality of the indicia.

3. A gaming system in accordance with claim 1, further comprising a player input allowing a player to make a player predicted outcome for the secondary game.

4. A gaming system in accordance with claim 3, the player input being configured to allow the player to bet credit against the player predicted outcome for the secondary game.

5. A gaming system in accordance with claim 1, wherein the sequence selector is configured to provide a plurality of different sequences of particular ones of said non-consecutive successive repetitions of the primary game for selection.

6. A gaming system in accordance with claim 1, and further including a set of primary indicia, wherein the primary game comprises one or more indicia selected from the set of primary indicia, and further including a secondary set of indicia associated with the set of primary indicia, the secondary set of indicia being utilised to determine the outcome of the secondary game based on the associated primary indicia.

7. A gaming system in accordance with claim 1, and wherein the game controller is further configured to generate a feature game as an outcome of the secondary game.

8. A gaming system in accordance with claim 1, and wherein the game controller is further configured to generate a jackpot outcome as an outcome of the secondary game.

9. A gaming system in accordance with claim 1, and wherein the primary game is a wheel game.

10. A gaming system in accordance with claim 1, and wherein the primary game is a roulette game.

11. A gaming system in accordance with claim 1, and further comprising a display configured to display a representation of a reel game comprising one or more reels bearing symbols, the gaming system being configured to control the display to display the one or more reel symbols representing outcomes of the selected particular ones of non-consecutive successive repetitions of the primary game.

12. A method of gaming for use with a gaming system having a game controller and configured to allow a player to make sequential plays of a primary game in order to provide a secondary game, the method comprising:

receiving (1) a selection from the player via the game controller of particular ones of non-consecutive successive repetitions of the primary game and (2) a selection of outcomes associated with the particular ones of said non-consecutive successive repetitions of the primary game;

monitoring outcomes of the particular ones of said non-consecutive successive repetitions of the primary game;

determining an outcome of the secondary game in dependence on the selection of outcomes associated with the particular ones of said non-consecutive successive repetitions of the primary game;

dynamically calculating by the game controller a paytable in dependence on the outcomes of the particular ones of said non-consecutive successive repetitions of the primary game; and determining a prize using the dynamically calculated paytable.

13. A method in accordance with claim 12, wherein the outcomes associated with the selection of particular ones of said non-consecutive successive repetitions of the primary game are a plurality of indicia and wherein determining an outcome of the secondary game comprises combining the plurality of indicia.

14. A method in accordance with claim 12, and further comprising receiving a predicted outcome for the secondary game.

15. A method in accordance with claim 14, and further comprising receiving a betting credit against the predicted outcome for the secondary game.

16. A method in accordance with claim 12, and further comprising providing a plurality of different sequences of particular ones of said non-consecutive successive repetitions of the primary game.

17. A method in accordance with claim 12, wherein the primary game comprise selecting one or more indicia from a set of primary indicia, and wherein the method further comprises providing a secondary set of indicia associated with the primary indicia, the secondary set of indicia being utilised to determine the outcome of the secondary game based on the associated primary indicia.

18. A method in accordance with claim 12, and further comprising generating a feature game as an outcome of the secondary game.

19. A method in accordance with claim 12, and further comprising generating a jackpot outcome as an outcome of the secondary game.

20. A method in accordance with claim 12, wherein the primary game is a wheel game.

21. A method in accordance with claim 20, wherein the primary game is a roulette game.

22. A method in accordance claim 12, further comprising displaying a representation of a reel game comprising one or more reels bearing symbols, and displaying on the one or more reels symbols representing outcomes.

* * * * *

UNITED STATES PATENT AND TRADEMARK OFFICE

CERTIFICATE OF CORRECTION

PATENT NO. : 8,758,112 B2
APPLICATION NO. : 12/133997
DATED : June 24, 2014
INVENTOR(S) : Lyons et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 710 days.

Signed and Sealed this
Fourth Day of August, 2015

Michelle K. Lee

Michelle K. Lee
*Director of the United States Patent and Trademark Office*